US005531492A

United States Patent [19]

Raskevicius

[11] Patent Number: 5,531,492

[45] Date of Patent: Jul. 2, 1996

[54] RATCHETING LATCH MECHANISM FOR A VERTICAL ROD DOOR EXIT DEVICE

[75] Inventor: Leo Raskevicius, North Haven, Conn.

[73] Assignee: Sargent Manufacturing Company, New Haven, Conn.

[21] Appl. No.: 565,011

[22] Filed: Nov. 30, 1995

Related U.S. Application Data

[63] Continuation of Ser. No. 131,128, Oct. 4, 1993, abandoned.

[51] Int. Cl.[6] ..... E05B 63/20

[52] U.S. Cl. ..... 292/335; 292/92; 292/153

[58] Field of Search ..... 292/335, 21, 92, 292/153

[56] References Cited

U.S. PATENT DOCUMENTS

| | | | |
|---|---|---|---|
| D. 268,003 | 2/1983 | Ohno | D8/302 |
| D. 279,647 | 7/1985 | Ohno | D8/302 |
| 1,674,760 | 6/1928 | Carroll | 292/92 |
| 2,710,216 | 6/1955 | Eichacker | 292/335 |
| 2,781,218 | 2/1957 | Jewett | 292/336 |
| 2,953,916 | 9/1960 | Thomas | 292/153 X |
| 3,123,387 | 3/1964 | Jackson et al. | 292/21 |
| 3,582,122 | 6/1971 | Foster | 292/21 X |
| 3,677,043 | 7/1972 | Cox | 292/335 X |
| 3,722,938 | 3/1973 | Bauer et al. | 292/92 |
| 4,145,900 | 3/1979 | Ohno | 70/92 |
| 4,384,738 | 3/1983 | Floyd | 292/92 |
| 4,387,917 | 6/1983 | Cocker | 292/93 X |
| 5,139,292 | 8/1992 | Beals | 292/21 X |

FOREIGN PATENT DOCUMENTS

| | | | |
|---|---|---|---|
| 1357 | 4/1926 | Australia | 292/335 |
| 316620 | 4/1934 | Italy | 292/335 |

*Primary Examiner*—Rodney M. Lindsey
*Attorney, Agent, or Firm*—DeLio & Peterson

[57] ABSTRACT

A ratcheting latch mechanism for holding the vertical rods of a door exit device in the retracted position includes a chassis and a latch rod, with a plurality of ratchet notches formed therein, slidingly held by the chassis for motion between an extended and a retracted position. One end of the latch rod engages a socket in the door frame, the other is connected to a vertical rod extending from the exit device. A pawl is mounted on a release mechanism and engages the ratchet notches whenever the door is open to prevent the latch rod from moving back towards the extended position and damaging flooring or ceiling material.

3 Claims, 3 Drawing Sheets

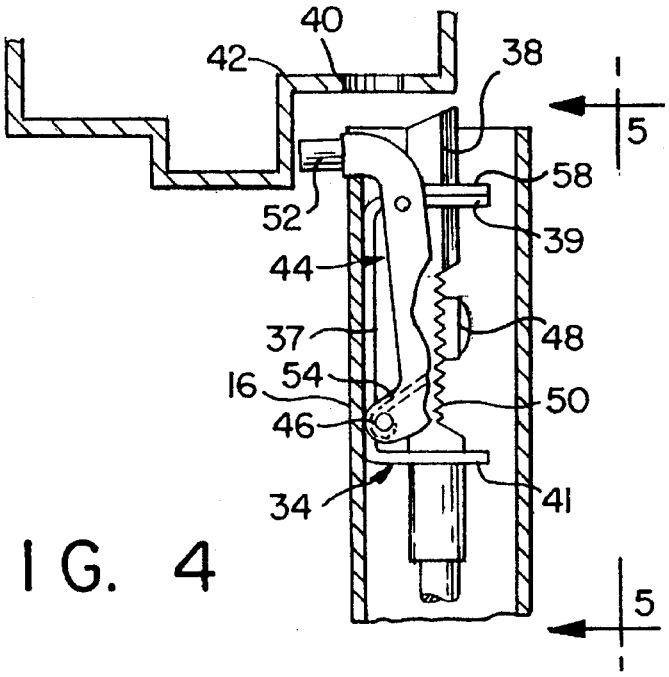
FIG. 4
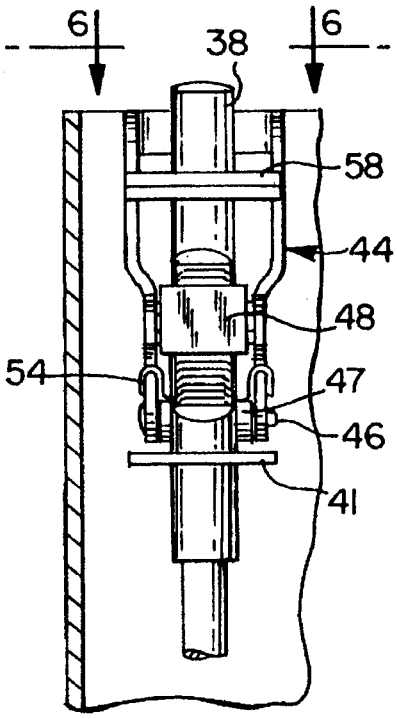
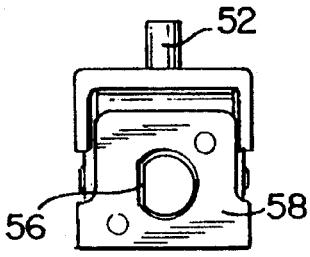
FIG. 6
FIG. 5

RATCHETING LATCH MECHANISM FOR A VERTICAL ROD DOOR EXIT DEVICE

This is a continuation of U.S. patent application Ser. No. 08/131,128 filed on Oct. 4, 1993, now abandoned.

BACKGROUND OF THE INVENTION

1. Field of the Invention

This invention relates to door exit devices in which a handle retracts upper and a lower vertical rods out of corresponding latch sockets in a door frame and pulls them into the door. More specifically, the invention relates to the latch mechanism which retains the vertical rods in the retracted position while the door is open to prevent inadvertent extension of the vertical rods and possible damage to the floor or ceiling as the door swings open.

2. Description of Related Art

Vertical rod door exit devices are widely used in schools, factories and commercial buildings, often in emergency exit applications. Devices of this type, have a handle, commonly a horizontal push bar or push plate, which moves in towards the door to retract an upper vertical rod from an upper socket in the door frame and a lower vertical rod from a socket in the floor. With the vertical rods retracted from their respective sockets, the door is free to swing open.

The horizontally operating handle of these devices provides simple and reliable door opening actuation, even in panic situations, and the vertical rods provide a connection between the door and the door frame which is highly resistant to forced entry.

In such devices, as the handle is operated, the vertical rods are retracted out of their respective sockets and into the door where a retraction latch mechanism operates to hold them in the retracted position until the door has been closed again. One problem with previous designs is that the latch mechanism occasionally fails to operate properly, or releases while the door is open. At such times, the vertical rods extend out from their retracted position and into contact with the floor or ceiling. This often results in damage if the door is moved while the rods are in contact with finished flooring or ceiling material.

Prior art vertical rod door exit devices have heretofore employed a latch mechanism which operates at a single preset retraction point. When the vertical rod to which the latch is attached is retracted to the specified point, the latch engages and prevents the rod from extending beyond this point until the door has been closed again. Closing the door operates a release on the latch and allows the vertical rods to extend into their sockets in the door frame.

In order to guarantee that the retraction latch will operate whenever the door is opened, the preset point could be set at the exact point where the vertical rods have been retracted just clear of their respective sockets. However, this "guaranteed operation point" setting would not normally provide sufficient clearance between the partially retracted rods and the flooring or ceiling material. Moreover, it would not be economically feasible to provide different latches, factory set to this point, or to individually adjust each latch in the field, as would be necessary to accommodate varying clearances between the door and door frames.

Accordingly, in all prior art vertical rod door exit devices, the retraction latch is factory set to operate beyond the guaranteed operation point discussed above, usually at a point close to the fully retracted position. In normal operation the vertical rods will almost always be pulled past the retraction latch actuation point, even with relatively light operating pressure on the handle. However, very occasionally the handle will be operated only partially, enough to withdraw the vertical rods from the sockets in the floor and ceiling and open the door, but insufficiently to retract the vertical rods to the retraction latch actuation point.

When this happens, the door is freed to swing open, but the rods are not latched and move into damaging contact with the floor or ceiling as soon as pressure is released from the handle. The result is usually an arc of damage on the flooring or ceiling material.

Bearing in mind these problems and deficiencies of the prior art, it is therefore an object of the present invention to provide a latch mechanism which prevents the vertical rods from damaging the flooring or ceiling or from moving towards the extended position inadvertently.

Another object of the invention is to provide a latch mechanism for a vertical rod door exit device which always latches the vertical rods whenever the door is open.

A further object of the invention is to provide a latch mechanism which is capable of latching at all points along the retraction stroke of the vertical rod and which operates immediately to prevent any motion of the vertical rods towards the extended position once they have begun to move towards the retracted position.

It is another object of the present invention to provide a latch mechanism which is reliable and inexpensive to manufacture.

Still other objects and advantages of the invention will in part be obvious and will in part be apparent from the specification.

SUMMARY OF THE INVENTION

The above and other objects, which will be apparent to those skilled in the art, are achieved in the present invention which is directed to a ratcheting latch mechanism for a vertical rod door exit device which holds the vertical rods in the retracted position whenever the door is open. The latch includes a chassis holding a latch rod that slides between an extended and a retracted position. The latch rod is adapted for connection to a vertical rod extending from the vertical rod door exit device and has a plurality of ratchet notches formed along its length with one end being adapted to protrude from the chassis and engage a socket in a door frame.

A pawl is positioned to engage one or more ratchet notches and prevent motion of the latch rod towards the extended position after the door has opened. A release mechanism is provided for releasing the pawl and allowing the latch rod to return to the extended position when the door is closed.

In the preferred design, the release mechanism comprises a release frame having the pawl mounted thereon. The release frame is movably mounted on the chassis for motion between an engaged position in which the pawl can engage one or more ratchet notches on the latch rod and a released position in which the pawl is clear of the ratchet notches permitting the latch rod to slide from the retracted to the extended position when the door is closed.

A contact piece, preferably in the form of a pin extending perpendicular to the latch rod, is mounted on the release frame and contacts the door frame as the door is closed to move the release frame into the released position. A spring is mounted between the chassis and release frame for urging the release frame into the engaged position whenever the contact piece is not in contact with a door frame. The release frame is pivotally mounted to the chassis at one end with the contact piece being mounted on the other end and the pawl being mounted therebetween.

In the most highly preferred design, the pawl includes multiple engaging teeth, at least two of which engage at least two corresponding ratchet notches when the latch rod is in the retracted position and the release frame is in the engaged position.

The latch rod is preferably designed with a non-circular cross-section along at least a portion of its length, with a corresponding non-circular opening in the chassis to prevent rotation of the latch rod and maintain alignment of the ratchet notches with the pawl.

BRIEF DESCRIPTION OF THE DRAWINGS

For a fuller understanding of the invention, reference should be made to the following description taken in connection with the accompanying drawings, in which:

FIG. 4 is a side elevational view of the ratcheting latch mechanism of the present invention similar to FIG. 3, except with the latch rod shown in the retracted position and the release frame shown in the engaged position.

FIG. 5 is a front elevational view of the ratcheting latch mechanism of the present invention from the right side of FIG. 4.

FIG. 6 is a top elevational view of the ratcheting latch mechanism of the present invention from the top of FIG. 5.

DESCRIPTION OF THE PREFERRED EMBODIMENT

Figure 1:
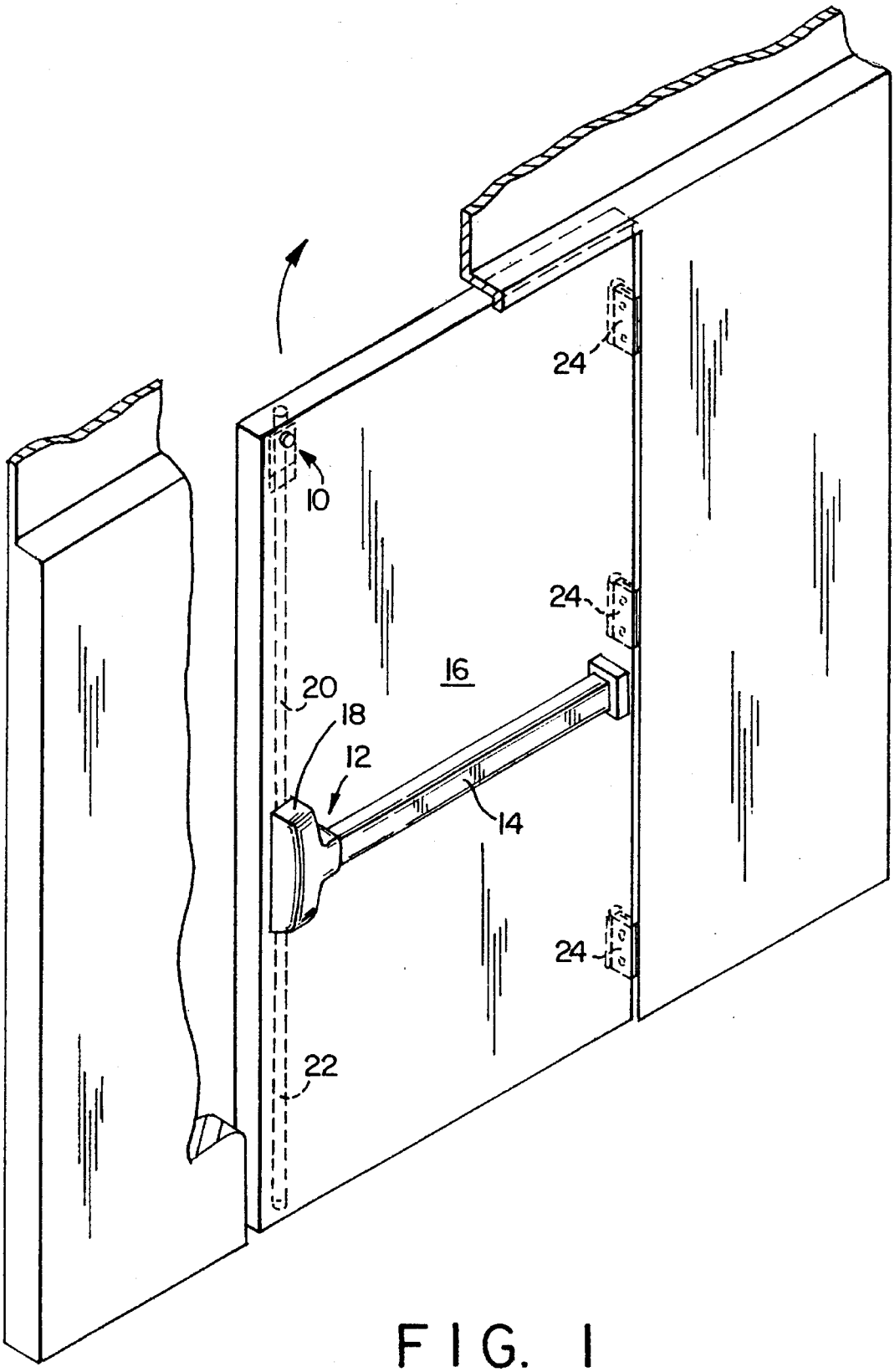
FIG. 1 is a perspective view showing the operating environment of the invention comprising a door and a vertical rod door exit device mounted thereon, with the ratcheting latch mechanism of the present invention connected to the upper vertical rod of the exit device.

In describing the preferred embodiment of the present invention, reference will be made herein to FIGS. 1–6 of the drawings in which like numerals refer to like features of the invention. Features of the invention are not necessarily shown to scale in the drawings.

FIG. 1 illustrates the environment in which the present invention operates. The ratcheting latch mechanism is generally indicated with reference numeral 10 and is located internal to a door 16 equipped with a vertical rod door exit device 12.

The vertical rod door exit device includes a handle 14 extending horizontally across the surface of door 16. When pressed, the handle 14 moves horizontally in towards the door 16 and operates the door exit device inside housing 18 to simultaneously retract an upper vertical rod 20 and a lower vertical rod 22 into the door.

As the vertical rods move from the extended to the retracted position, they withdraw latch rods 38, 39 from sockets in the upper door frame and floor releasing the door to swing open. The sockets may be formed in the door frame, in the floor, or in latch plates set into the floor or ceiling. When the vertical rods have been sufficiently retracted so that they are withdrawn from their sockets, the door 16 is free to swing open about hinges 24.

As will be described in greater detail, the latch mechanism 10 latches the moment the door opens to prevent any motion of the vertical rods back towards the extended position. The latching occurs as a result of the motion of the door away from the door frame and regardless of how far the rods have been retracted, so inadvertent extension of the rods due to partial handle actuation does not occur.

Figure 2:
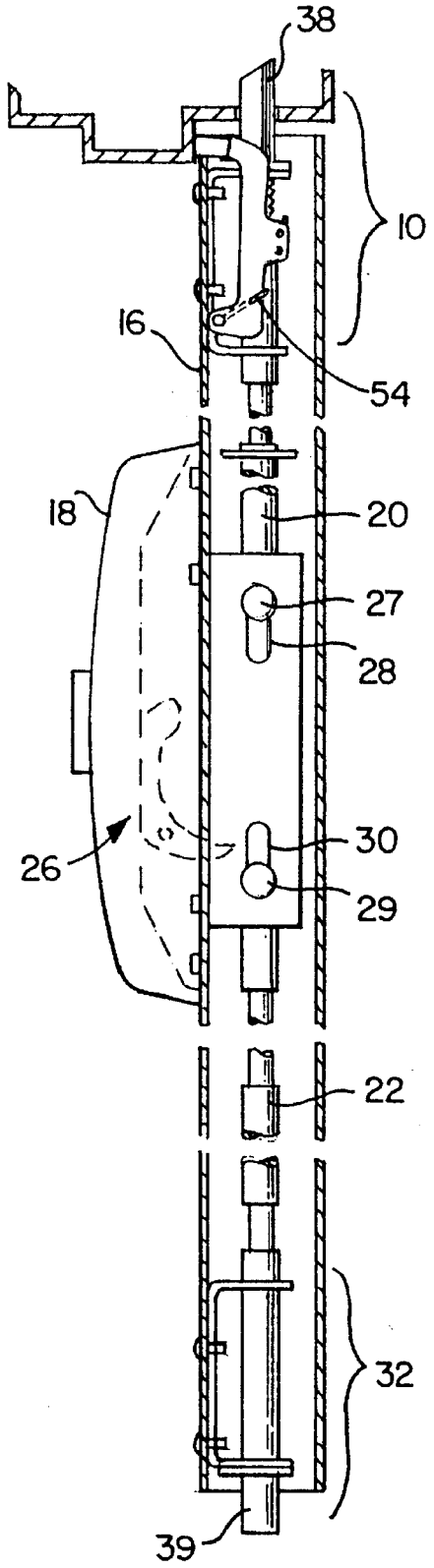
FIG. 2 is a side elevational view of the ratcheting latch mechanism of the present invention, also showing portions of the vertical rod door exit device and the door of FIG. 1 partly in cross-section.

Referring to FIG. 2, the vertical rod door exit device housing 18 incorporates a mechanism, indicated in dashed lines and generally marked with reference numeral 26, which converts the horizontal motion of handle 14 towards the door into a retracting motion which pulls the upper vertical rod 20 down and the lower vertical rod 22 up. The upper vertical rod 20 has a guide 27 which slides in an opening 28, and the lower vertical rod 22 has a guide 29 which slides in opening 30.

Different configurations for the handle 14 and mechanism 26 are possible and are known to the art. Accordingly, no specific description for the vertical rod retraction mechanism is shown, and the handle shown is only one of many possible configurations. Provided that the handle operates the mechanism and the mechanism longitudinally retracts at least one vertical rod out of a corresponding socket, they may be used with the ratcheting latch mechanism 10 further described below.

The latch mechanism in the present invention is shown attached to the upper vertical rod 20. This is sufficient to hold both vertical rods in the retracted position provided that the vertical rods are properly connected to operate together by the mechanism 26. In other designs, however, the retraction latch 10 might be used in connection with the lower vertical rod 22, or two ratcheting latch mechanisms could be used, one for each vertical rod.

Figure 3:
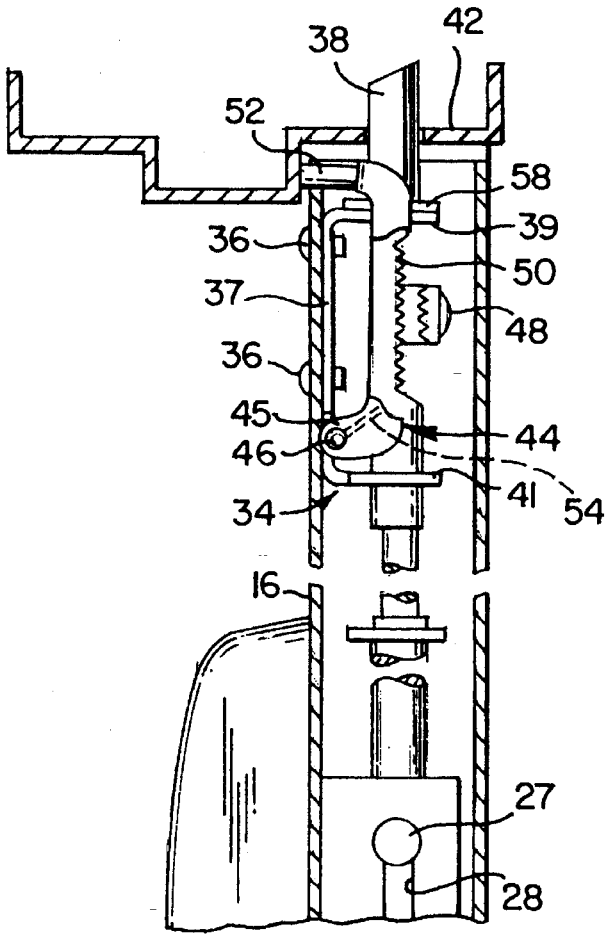
FIG. 3 is a side elevational view of the ratcheting latch mechanism of the present invention at an enlarged scale with the latch rod shown in the extended position and the release frame in the released position, as in FIG. 2, but with a portion of the release frame being cut away to show the ratchet notches and pawl.

Referring now to FIGS. 3–6, and particularly to the enlarged view of FIG. 3, the latch mechanism 10 employs a chassis 34 mounted to the door 16 by a pair of fasteners 36. The chassis is formed of a single piece having a back plate 37 fastened to the door surface and upper and lower support plates 39, 41 having openings through which the latch rod 38 slides.

The latch rod 38 is slidingly held by the chassis 34 for longitudinal motion between an extended position (shown in FIG. 3) and a retracted position. FIG. 4 shows the latch rod 38 in the partially retracted position. It has been retracted sufficiently to withdraw it from the latch opening 40 in the door frame 42, but has not been withdrawn completely within the door 16. It is this position in which prior art devices fail because the partial retraction is not sufficient to reach the latch point and engage the latch mechanism. In the present invention, however, the ratcheting design begins to engage immediately after the door moves away from the door frame 42.

Referring again to FIG. 3, the latch rod 38 includes a plurality of ratchet notches 50 formed along its length which are engaged by a pawl 48 whenever the door is open to prevent motion of the latch rod towards the extended position. The ratchet notches form multiple latch points spaced along the latch rod. The pawl 48 can engage at any of these latch points to latch the rod at any point of extension or retraction.

A release frame 44 is pivotally mounted to the chassis 34 on a first end about pin 46. The first end of the release frame has a pair of arms 45 bent around corresponding tabs 47 (see FIG. 5) extending out from the back plate 37. The pin 46 passes through the arms 45 and the tabs 47 to provide a hinge pin about which the release frame pivots.

The pawl 48 is mounted on the release frame and moves into and out of engagement with the ratchet notches 50 as the release frame moves between a released position (FIG. 3) in which pawl 48 is clear of the ratchet notches 50 and an engaged position (FIG. 4) in which pawl 48 engages the ratchet notches. The release frame 44 has a contact piece 52, in the shape of a rod extending perpendicular to the latch rod 38. When the door is closed, as shown in FIG. 3, the contact piece hits the door frame 42 rotating the release frame about pin 46 and moving the pawl 48 out of contact with the notches 50.

In the released position the latch rod is free to move into the extended position. The vertical rods are driven to the extended position through the weight of the components, by spring action or by other suitable means, depending upon the design of the vertical rod exit device mechanism.

A spring means 54 is wound around pivot pin 46 and exerts a force between chassis 34 and the release frame 44 to continuously urge the release frame towards the engaged position. Other devices for providing the desired force urging the release frame towards the engaged position, such as elastomeric materials, weights or the like may also be used. The spring pressure moves the release frame into the engaged position, extends the contact piece 52 and engages the pawl 48 as soon as the door clears the door frame 42.

As seen in FIG. 6, in the preferred design, latch rod 38 has a non-circular cross-section due to a machined flat 56 located along the side of the latch rod extending from the end of the latch rod to the ratchet notches 50. A corresponding opening of the same non-circular shape in an upper plate 58 slidingly engages the latch rod and prevents it from rotating. This maintains the proper alignment between the ratchet notches 50 and the pawl 48.

The relationship between the pin 46, the angle of the surfaces on the notches 50 and the pawl 48 is such that the pawl acts in a one-way ratcheting fashion to allow the latch rods to be further retracted, but not further extended, after the release frame has moved to the engaged position. This may occur if the handle is operated more completely after the door has been opened. The pawl simply rises up over each notch, lifting the frame against spring 54, and drops into the next available notch.

The lower end of the latch rod is connected to the vertical rod 20 by any suitable means. In the preferred design the latch rod has an axial opening in its end into which the vertical rod extends. A pin extends through and couples the two rods together. Alternatively the two rods may be threaded together or into a coupler to form the desired connection.

It will thus be seen that the objects set forth above, among those made apparent from the preceding description, are efficiently attained and, since certain changes may be made in the above construction(s) without departing from the spirit and scope of the invention, it is intended that all matter contained in the above description or shown in the accompanying drawing(s) shall be interpreted as illustrative and not in a limiting sense.

Thus, having described the invention, what is claimed is:

1. A ratcheting latch mechanism for a vertical rod door exit device to be mounted in a door hingedly attached to a door frame for motion between an open and a closed position comprising:

a chassis adapted for mounting within the door;

a latch rod slidingly held by the chassis for vertical motion from an extended to a retracted position and including:

a plurality of ratchet notches formed in the latch rod, a first end of the latch rod adapted to protrude from the chassis and engage a latch socket, and a second end of the latch rod adapted for connection to a vertical rod extending from a vertical rod door exit device;

a pawl having a plurality of teeth positioned to engage at least two of the ratchet notches to prevent motion of the latch rod towards the extended position, the pawl engaging the at least two of the ratchet notches responsive to motion of the door away from the closed position towards the open position, the pawl acting to engage the at least two of the ratchet notches and prevent motion of the latch rod towards the extended position when the latch rod is at the extended position, when the latch rod is at the retracted position and when the latch rod is at positions between the extended and retracted position; and a release mechanism for releasing the pawl and allowing the latch rod to return to the extended position when the door is in the closed position, the release mechanism comprising:

a release frame having a pair of frame members with the pawl mounted therebetween the release frame being hingedly mounted to the chassis about a hinge axis located at a first end of the release frame to move between an engaged position in which the pawl engages the at least two ratchet notches and a released position in which the pawl does not engage the at least two ratchet notches;

a contact piece mounted to the release frame at a second end of the release frame, the contact piece acting to move the release frame into the released position when the door reaches the closed position, the latch rod extending through the release frame between the pair of frame members with the hinge axis and the contact piece on one side of the latch rod and the notches and the pawl on an other side of the latch rod; and a spring means mounted between the chassis and release frame for urging the release frame into the engaged position when the door moves away from the closed position.

2. A ratcheting latch mechanism according to claim 1 wherein the contact piece comprises a pin extending from the chassis perpendicular to the latch rod.

3. A ratcheting latch mechanism according to claim 1 wherein the latch rod has a non-circular cross section along at least a portion of its length and the chassis includes a corresponding non-circular opening slidingly engaging the latch rod to prevent rotation thereof.

* * * * *